US011708253B2

(12) United States Patent
Jin et al.

(10) Patent No.: US 11,708,253 B2
(45) Date of Patent: Jul. 25, 2023

(54) HEAVY LOAD ELEVATOR INSTALLATION PLATFORM CAPABLE OF STRETCHING AND RETRACTING STEPLESSLY

(71) Applicant: WUXI RIGID MACHINERY CO., LTD., Wuxi (CN)

(72) Inventors: Huichang Jin, Wuxi (CN); Yongsheng Fu, Wuxi (CN); Huaiyin Qian, Wuxi (CN); Leilei Zhao, Wuxi (CN); Haoran Kuang, Wuxi (CN)

(73) Assignee: WUXI RIGID MACHINERY CO., LTD.

( * ) Notice: Subject to any disclaimer, the term of this patent is extended or adjusted under 35 U.S.C. 154(b) by 212 days.

(21) Appl. No.: 17/428,515

(22) PCT Filed: Mar. 5, 2021

(86) PCT No.: PCT/CN2021/079201

§ 371 (c)(1),
(2) Date: Aug. 4, 2021

(87) PCT Pub. No.: WO2021/238327

PCT Pub. Date: Dec. 2, 2021

(65) Prior Publication Data

US 2022/0324687 A1 Oct. 13, 2022

(30) Foreign Application Priority Data

May 28, 2020 (CN) ..... 202010466062.7

(51) Int. Cl.
*B66F 11/04* (2006.01)
*B66F 13/00* (2006.01)

(52) U.S. Cl.
CPC ..... *B66F 11/04* (2013.01); *B66F 13/00* (2013.01)

(58) Field of Classification Search
CPC ..... B66F 11/04; B66F 11/00; B66F 17/006; B66B 5/005; B66B 11/0226; B66D 5/00
See application file for complete search history.

(56) References Cited

U.S. PATENT DOCUMENTS 2,405,535 A * 8/1946 Weiss ..... B65D 19/38 206/386
2,739,776 A * 3/1956 Terando ..... B65D 19/0002 248/172

(Continued)

FOREIGN PATENT DOCUMENTS

CN 202717475 U 2/2013
CN 207108185 U 3/2018

(Continued)

OTHER PUBLICATIONS

International Search Report translation for International Application No. PCT/CN2021/079201, dated Jun. 16, 2021.

*Primary Examiner* — Michael A Riegelman
(74) *Attorney, Agent, or Firm* — Edmonds & Cmaidalka, P.C.

(57) ABSTRACT

A heavy load elevator installation platform capable of stretching and retracting steplessly, which includes an upper beam assembly and a lower beam assembly that can realize stepless stretching and retracting. The upper beam assembly includes an upper beam left C steel, upper beam middle C steel, and upper beam right C steel connected end to end in sequence. A plurality of long holes formed at an inclined included angle with the horizontal are formed in the inner side walls of each of the upper beam left C steel and the upper beam right C steel. A plurality of long holes are respectively formed in the two side surfaces, facing the upper beam left C steel and the upper beam right C steel, of (Continued)

the upper beam middle C steel. The structure of the lower beam assembly is the same as that of the upper beam assembly.

10 Claims, 7 Drawing Sheets

(56) References Cited

U.S. PATENT DOCUMENTS

| | | | | |
|---|---|---|---|---|
| 5,785,293 | A * | 7/1998 | Ford | F16M 3/00 248/676 |
| 6,076,692 | A * | 6/2000 | Avot | B65D 21/086 220/4.03 |
| 7,108,100 | B2 * | 9/2006 | Stingl | E04G 1/367 248/235 |
| 8,141,683 | B1 * | 3/2012 | Wurth | E04G 1/367 182/223 |
| 10,294,076 | B2 * | 5/2019 | Wurth | B66B 5/04 |
| 10,618,778 | B2 * | 4/2020 | Hu | B66B 11/0233 |
| 11,598,106 | B2 * | 3/2023 | Garbers | B66B 19/00 |
| 2010/0018809 | A1 * | 1/2010 | Peacock | B66B 19/00 187/351 |
| 2015/0175388 | A1 * | 6/2015 | Klappholz | B66B 11/0253 187/401 |
| 2018/0370768 | A1 * | 12/2018 | Salin | F16B 5/0607 |
| 2018/0370769 | A1 * | 12/2018 | Häivälä | B66B 11/0206 |
| 2019/0194957 | A1 * | 6/2019 | Wurth | E04G 1/367 |
| 2022/0324687 | A1 * | 10/2022 | Jin | B66B 11/0226 |

FOREIGN PATENT DOCUMENTS

| | | | |
|---|---|---|---|
| CN | 208413608 | U | 1/2019 |
| CN | 111498760 | A | 8/2020 |
| CN | 212832664 | U | 3/2021 |
| JP | 11171428 | A | 6/1999 |
| JP | 2012184101 | A | 9/2012 |

* cited by examiner

HEAVY LOAD ELEVATOR INSTALLATION PLATFORM CAPABLE OF STRETCHING AND RETRACTING STEPLESSLY

CROSS-REFERENCE TO RELATED APPLICATIONS

This patent application claims the benefit and priority of Chinese Patent Application No. 202010466062.7, filed on May 28, 2020, and International Application No. PCT/CN2021/079201, filed on Mar. 5, 2021, the disclosures of which are incorporated by reference herein in their entirety as part of the present application.

BACKGROUND OF THE INVENTION

Field of the Invention

The present disclosure relates to a heavy load elevator installation platform capable of stretching and retracting steplessly, and belongs to the technical field of aerial operation of construction machinery.

Description of the Related Art

With the popularization of medium and high rise buildings, elevators have become indispensable transportation tools. However, elevator installation and construction technologies are still relatively backward, and generally, scaffoldings are used for installation. The installation methods using the scaffoldings are a waste of time, effort, and labor, and have low safety. For large-area building groups and long-term installation, the operation cost is high.

At present, part elevator manufacturers use special installation platforms with respect to the above-mentioned problems. However, the commonly used installation platforms in the industry are generally scattered in structure and inconvenient to connect, and the installation time in an early stage of construction is long. Meanwhile, the platforms are generally not adjustable or can only be subjected to interval adjustment. The interval adjustment means that there are several hole positions at intervals, and the platforms can only be adjusted from one hole to another. The platforms that are not adjustable only have one installation dimension, which is difficult to adapt to the installation conditions of various dimensions. The interval adjustment will inevitably miss a lot of dimensions. If elevator shafts are just in these dimensions, the platforms are not applicable. The platforms have insufficient applicability to the elevator shafts with different rail gauges. In addition, the load capacity is low. For the medium and high rise buildings, many construction tools or materials need to be carried at one time, and more and more elevator manufacturers start to apply special equipment for installation. The weight of the special equipment is obviously increased compared with that of conventional hand tools or old equipment, so the elevator load is insufficient.

SUMMARY OF THE INVENTION

An objective of the present disclosure is to provide a heavy load elevator installation platform which is convenient to use, wide in adaptability, and safe and reliable, so as to overcome the shortcomings of the prior art. The key points of a technical solution are that the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. The inclined long holes in the upper beam middle C steel and the lower beam middle C steel are set as even rows, and are symmetrically formed by taking a central point of the upper beam middle C steel or the lower beam middle C steel as a center of symmetry.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. A telescopic rod is further arranged at the lower beam assembly. Lower beam support seats are arranged at two ends of the lower beam assembly. The telescopic rod includes: an end screw, one end being connected to a lower beam support seat at the lower beam right C steel, and the other end pointing to the lower beam middle C steel; a middle screw, connected to one end, deviating from the lower beam right C steel, of the end screw, and a turnbuckle being connected between the middle screw and the end screw; an end connecting rod, connected to one end, deviating from the end screw, of the middle screw, and being in threaded connection with the middle screw.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. A telescopic rod is further arranged at the lower beam assembly. Lower beam support seats are arranged at two ends of the lower beam assembly. The telescopic rod includes: an end screw, one end being connected to a lower beam support seat at the lower beam right C steel, and the other end pointing to the lower beam middle C steel; a middle screw, connected to one end, deviating from the lower beam right C steel, of the end screw, and a turnbuckle being connected between the middle screw and the end screw; an end connecting rod, connected to one end, deviating from the end screw, of the middle screw, and being in threaded connection with the middle screw. External screw threads with opposite screw directions are formed in the outer circular surfaces of the ends, close to each other, of the end screw and the middle screw; internal screw threads with opposite screw directions are formed in the inner walls of two ends of the turnbuckle.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. A telescopic rod is further arranged at the lower beam assembly. Lower beam support seats are arranged at two ends of the lower beam assembly. The telescopic rod includes: an end screw, one end being connected to a lower beam support seat at the lower beam right C steel, and the other end pointing to the lower beam middle C steel; a middle screw, connected to one end, deviating from the lower beam right C steel, of the end screw, and a turnbuckle being connected between the middle screw and the end screw; an end connecting rod, connected to one end, deviating from the end screw, of the middle screw, and being in threaded connection with the middle screw. One end, deviating from the end screw, of the middle screw is set as a circular tubular shape; a plurality of holes are formed in the outer circular surface of the circular tubular section; a plurality of holes that can be overlapped with the holes in the middle screw are formed in the outer circular surface of one end, close to the middle screw, of the end connecting rod.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. A triggering plate is arranged on the lower beam left C steel. A pin hole is formed in the triggering plate. A rotating rod used for fixing the triggering plate is penetrated in the pin hole. The rotating rod rotates around the pin hole at the lower beam left C steel. A load-bearing bottom frame consists of a plurality of profiles with grooves and bumps that are engaged with each other, and includes skirting boards and transverse connecting rods that are arranged perpendicular to each other. The transverse connecting rods are located at the bottom surface of the load-bearing bottom frame; the skirting boards surround the periphery of the load-bearing bottom frame.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. A triggering plate is arranged on the lower beam left C steel. A pin hole is formed in the triggering plate. A rotating rod used for fixing the triggering plate is penetrated in the pin hole. The rotating rod rotates around the pin hole at the lower beam left C steel. A load-bearing bottom frame consists of a plurality of profiles with grooves and bumps that are engaged with each other, and includes skirting boards and transverse connecting rods that are arranged perpendicular to each other. The transverse connecting rods are located at the bottom surface of the load-bearing bottom frame; the skirting boards surround the periphery of the load-bearing bottom frame. The skirting boards include first skirting boards and second skirting boards that are engaged with each other. The first skirting boards are located on the periphery of the load-bearing bottom frame. The first skirting boards and the second skirting boards are connected end to end in pairs. Each second skirting board is located at the middle section position of the corresponding first skirting board. The first skirting boards perform sliding movement along the axial direction of the second skirting boards.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. A triggering plate is arranged on the lower beam left C steel. A pin hole is formed in the triggering plate. A rotating rod used for fixing the triggering plate is penetrated in the pin hole. The rotating rod rotates around the pin hole at the lower beam left C steel. A load-bearing bottom frame consists of a plurality of profiles with grooves and bumps that are engaged with each other, and includes skirting boards and transverse connecting rods that are arranged perpendicular to each other. The transverse connecting rods are located at the bottom surface of the load-bearing bottom frame; the skirting boards surround the periphery of the load-bearing bottom frame. Two transverse connecting rods are embedded and engaged with each other to form a pair of telescopic cross beams with an upper surface and a lower surface overlapped with each other. The two transverse connecting rods perform relative sliding movement along the axes of each other.

In one embodiment of the present disclosure, the heavy load elevator installation platform includes an upper beam assembly and a lower beam assembly that can realize stepless stretching and retracting. The upper beam assembly includes: upper beam left C steel, located at the bottom of an elevator platform to achieve a supporting effect, and a plurality of long holes formed at an inclined included angle with the horizontal being formed in the inner side wall of the upper beam left C steel; upper beam middle C steel, connected to one end of the upper beam left C steel; upper beam right C steel, connected to one end, deviating from the upper beam left C steel, of the upper beam middle C steel, and a plurality of long holes formed at an inclined included angle with the horizontal being formed in the inner side wall of the upper beam right C steel. A plurality of long holes are respectively formed in the two side surfaces, facing the upper beam left C steel and the upper beam right C steel, of the upper beam middle C steel. The long holes are formed at an inclined included angle with the horizontal. The inclination directions of the long holes of the upper beam middle C steel are opposite to the inclination directions of the long holes in the upper beam left C steel and the upper beam right C steel. The lower beam assembly includes: lower beam left C steel, located at the bottom of an elevator platform to achieve a supporting effect, and a plurality of long holes formed at an inclined included angle with the horizontal being formed in the inner side wall of the lower beam left C steel; lower beam middle C steel, connected to one end of the lower beam left C steel; lower beam right C steel, connected to one end, deviating from the lower beam left C steel, of the lower beam middle C steel, and a plurality of long holes formed at an inclined included angle with the horizontal being formed in the inner side wall of the lower beam right C steel. A plurality of long holes are respectively formed in the two side surfaces, facing the lower beam left C steel and the lower beam right C steel, of the lower beam middle C steel. The long holes are formed at an inclined included angle with the horizontal The inclination directions of the long holes of the lower beam middle C steel are opposite to the inclination directions of the long holes in the lower beam left C steel and the lower beam right C steel. The heavy load elevator installation platform further includes a vertical beam located at the outer side wall of the elevator platform. A plurality of circular holes that are symmetrically distributed along the middle surface of the vertical beam and are used for installing side rollers are formed in the vertical beam. The difference between the spacing of the circular holes and the diameter of the side rollers is wider than the width of an elevator guide rail outside.

Among others, the present disclosure has the following advantages and effects:

1. All of a load-bearing bottom frame, the upper beam assembly, the lower beam assembly, a railing, and a ceiling of the present disclosure can realize stepless stretching and retracting, which can be adapted to all guide rail spacing within its adjustment range, can be applied to various elevator shafts with different sizes, and has wide and universal adaptability.

2. A hoisting machine is installed on one side, and a 2:1 transmission effect can be achieved by means of a pulley, so that the load capacity is greatly improved, and the advantages to installation occasions with high load requirements are obvious.

3. The elevator installation platform of the present disclosure is subjected to dual protection by using safety clamps and a safety lock, so the safety coefficient is high.

Main reference signs in drawings: 1-safety clamp; 2-lower beam assembly; 3-upper beam assembly; 4-load-bearing bottom frame; 5-steel wire rope fixing seat; 6-thin railing; 7-thick railing; 8-inner ceiling plate; 9-outer ceiling plate; 10-hoisting machine; 11-safety lock; 12-vertical railing; 13-hoisting machine fixing seat; 14-safety lock fixing seat; 15-upper beam fixing plate; 16-ceiling support pipe; 17-ceiling sleeve; 18-cross pipe clamp; 19-inclined bracing pipe; 20-vertical beam assembly; 21-locking nut; 22-locking taper sleeve; 23-upper beam left C steel; 24-upper beam middle C steel; 25-upper beam connecting plate; 26-upper beam right C-steel; 27-lower beam left C steel; 28-lower beam middle C steel; 29-lower beam right C steel; 30-lower beam support seat; 31-spring; 32-end screw; 33-turnbuckle; 34-middle screw; 35-rotating rod; 36-triggering plate; 37-pulling plate; 38-vertical railing connector; 39-first skirting board; 40-second skirting board; 41-transverse connecting rod; 42-fixed folding plate; 43-vertical beam; 44-rear roller; 45-side roller; 46-end connecting rod.

DETAILED DESCRIPTION

The present disclosure is described in detail below.

Figure 1:
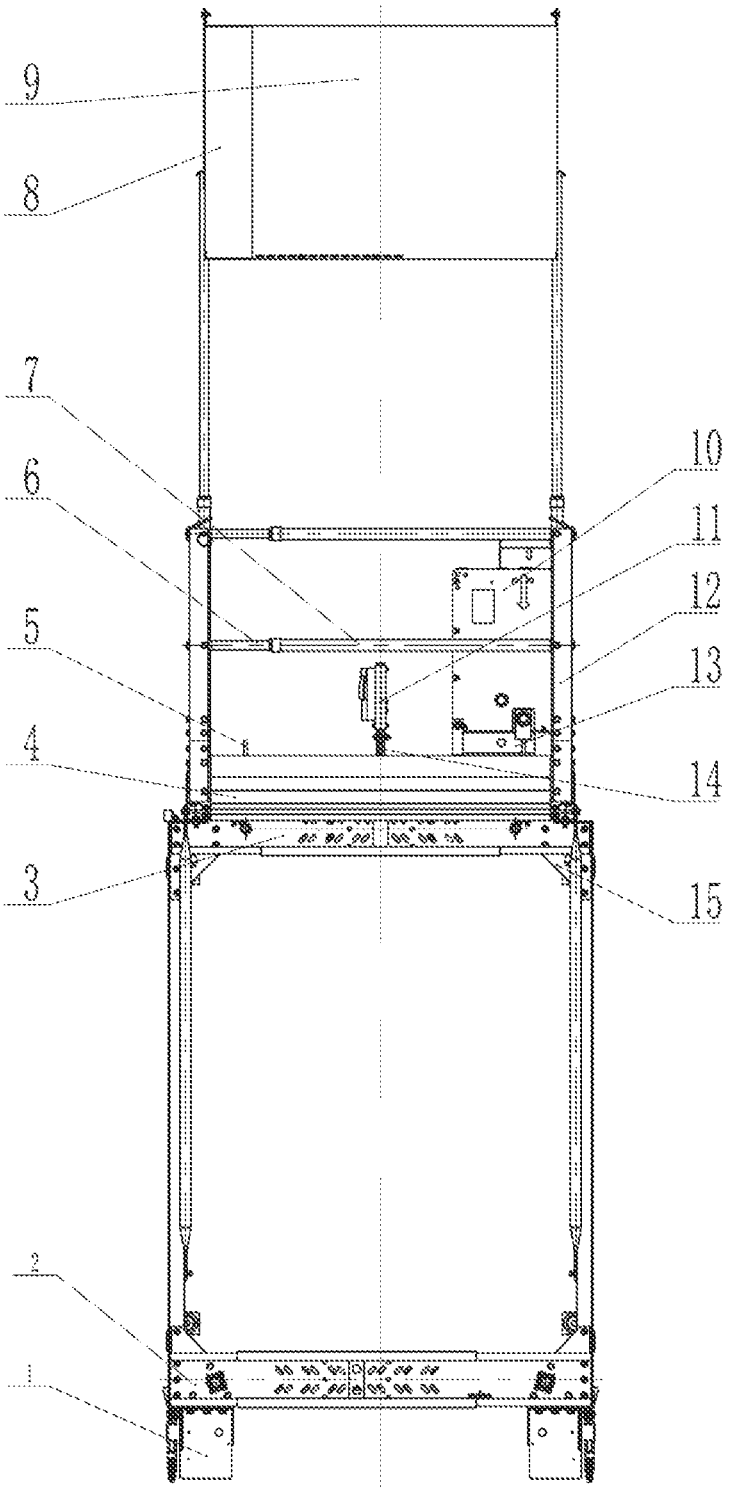
FIG. 1 is a front view of a whole body of the present disclosure.
Figure 2:
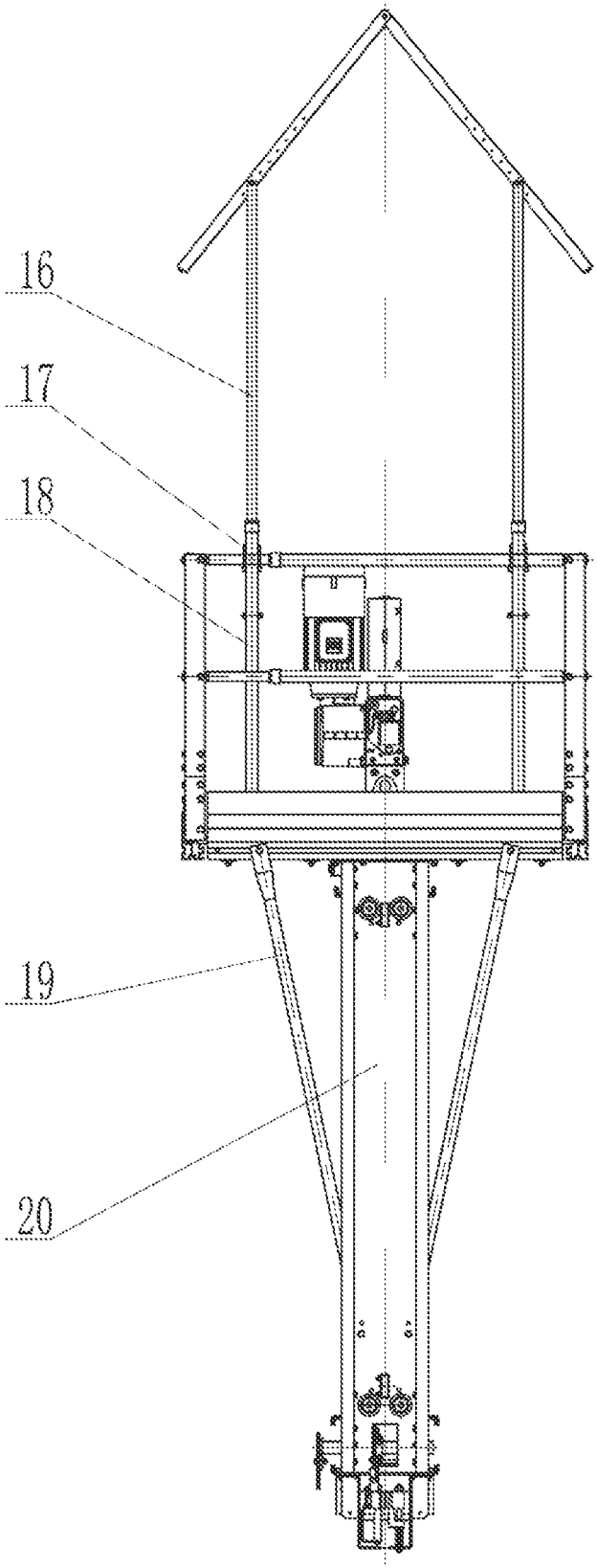
FIG. 2 is a side view of the whole body of the present disclosure.

A heavy load elevator installation platform capable of stretching and retracting steplessly, as shown in FIG. 1, includes a safety clamp 1 located at the bottommost part and a lower beam assembly 2 located above the safety clamp 1. An upper beam assembly 3 is arranged on one side, deviating from the safety clamp 1, of the lower beam assembly 2, that is, above the lower beam assembly 2. The upper beam assembly 3 is connected to the lower beam assembly 2 through vertical section steel. A load-bearing bottom frame 4 is attached to one side, deviating from the lower beam assembly 2, of the upper beam assembly 3, that is, the upper part of the upper beam assembly 3. Two ends of the upper beam assembly 3 are fixed to the upper part of an assembly 20 of a vertical beam 43 through an upper beam fixing plate 15. Two long beams of the lower beam assembly 2 are installed together through lower beam support seats 30. The lower beam assembly 2 is fixed to the lower part of the assembly 20 of the vertical beam 43.

Figure 4:
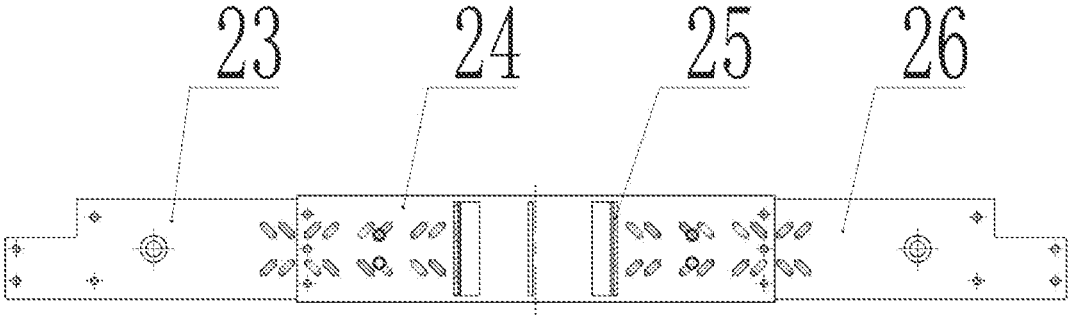
FIG. 4 is a schematic structural diagram of an upper beam of the present disclosure.
Figure 5:
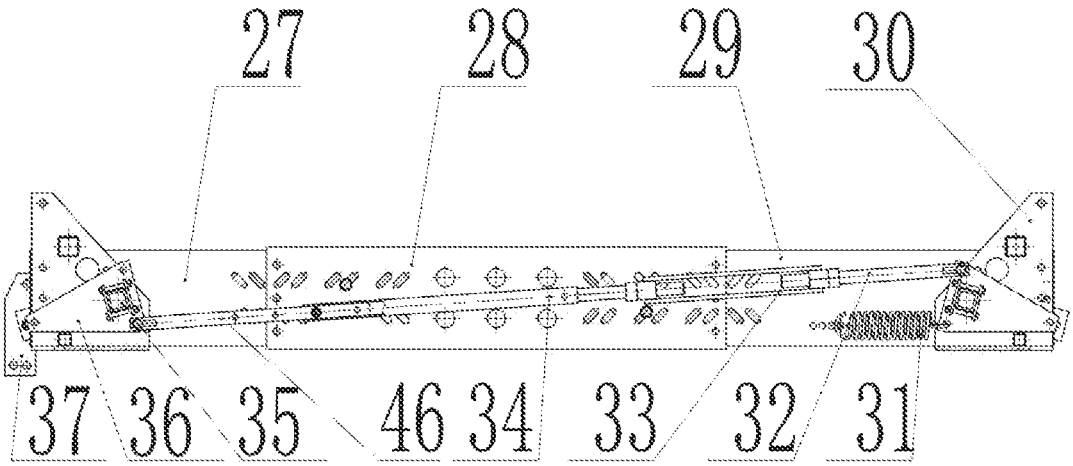
FIG. 5 is a schematic structural diagram of a lower beam of the present disclosure.

As shown in FIG. 4, the upper beam assembly 3 includes upper beam left C steel 23, upper beam middle C steel 24, and upper beam right C steel 26 that are connected end to end in sequence; an upper beam connecting plate 25 is further arranged at the middle section position of the upper beam middle C steel 24. As shown in FIG. 5, the lower beam assembly 2 includes lower beam left C steel 27, lower beam middle C steel 28, and lower beam right C steel 29 that are connected end to end in sequence. A lower beam support seat 30 is arranged at one end, deviating from the lower beam middle C steel 28, of the lower beam right C steel 29. A spring 31 is connected between the lower beam support seat 30 and the lower beam right C steel 29. An end screw 32 is further led out from the lower beam support seat 30. One end, deviating from the lower beam right C steel 29, of the end screw 32 extends to connect a middle screw 34. The middle screw 34 is connected to the end screw 32 through a turnbuckle 33. One end, deviating from the end screw 32, of the middle screw 34 extends to connect an end connecting rod 46. The middle screw 34 is also connected to the end connecting rod 46 by using a turnbuckle 33. The end connecting rod 46 extends to the lower beam left C steel 27. A triggering plate 36 is arranged at one end, deviating from the lower beam middle C steel 28, of the lower beam left C steel 27. A pulling plate 37 is arranged on one side, deviating from the lower beam left C steel 27, of the triggering plate 36. One end, deviating from the middle screw 34, of the end connecting rod 46 is connected to the triggering plate 36. The triggering plate 36 is connected to the end connecting rod 46 through a rotating rod 35 in a penetrating manner.

Figure 6:
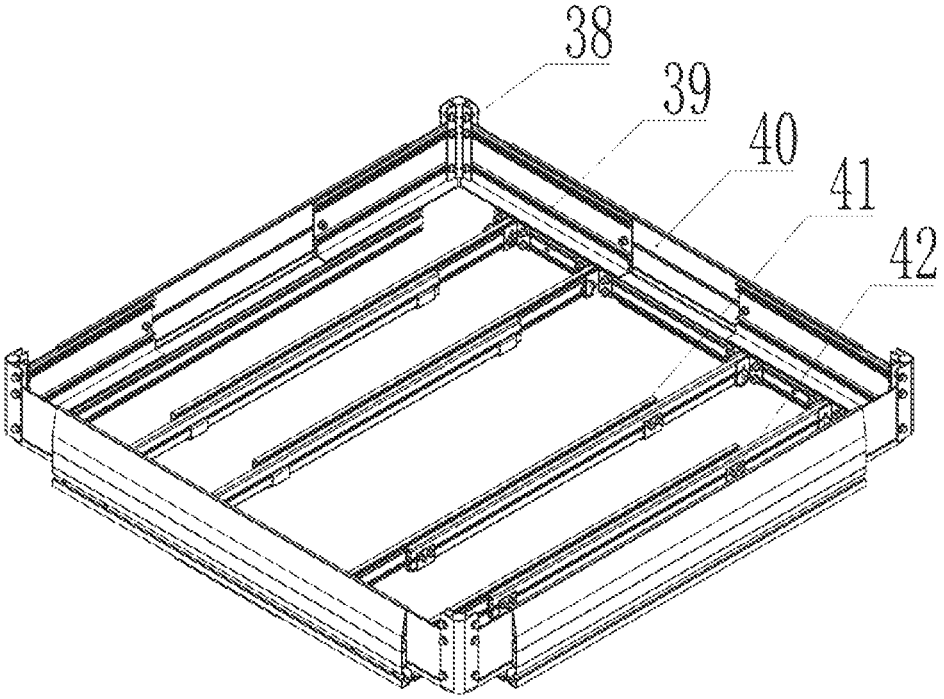
FIG. 6 is a schematic diagram of a load-bearing bottom frame of the present disclosure.

As shown in FIG. 6, the load-bearing bottom frame 4 includes vertical railing connectors 38 located at four vertexes of a rectangular frame, first skirting boards 39 connected between two adjacent vertical railing connectors 38, second skirting boards 40 located at the middle section positions of the first skirting boards 39, a plurality of transverse connecting rods 41 for connecting two opposite sides of the rectangular frame, and fixed folding plates 42 located at the middle section positions of the transverse connecting rods 41. The overall load-bearing bottom frame 4 is of a cubic structure.

Figure 3:
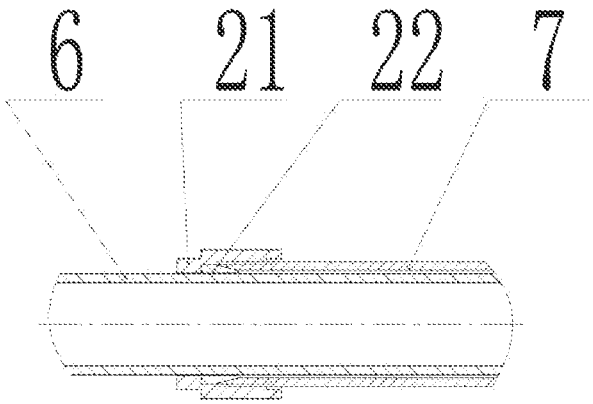
FIG. 3 is a connection schematic diagram of a railing of the present disclosure.

As shown in FIG. 1 and FIG. 6, the upper part of the load-bearing bottom frame 4 is connected to a steel wire rope fixing seat 5, a safety lock 11, and a hoisting machine 10 fixing seat. The hoisting machine 10 fixing seat is fixedly connected to a hoisting machine 10. Railings that are horizontally arranged are arranged on the periphery of the hoisting machine 10. The railings surround into a frame shape, which is overlapped with horizontal projections of the upper beam assembly 3, the lower beam assembly 2, and the load-bearing bottom frame 4. As shown in FIG. 3, each railing consists of two coaxial sections, namely, a thin railing 6 and a thick railing 7. The thin railing 6 can be inserted into the thick railing 7. External screw threads are formed in the tail end of the thick railing 7, and an inner hole is chamfered. A chamfered surface is matched with an inclined surface of a locking taper sleeve 22. The locking taper sleeve 22 is installed among the thick railing 7, the thin railing 6, and a locking nut 21. An open groove is formed in the inclined surface of the locking taper sleeve. In a thread tightening process of the locking nut 21 and the thick railing 7, the inclined surface of the locking taper sleeve extends into a gap between the thick railing 7 and the thin railing 6, so as to realize relative tightening of two railings. The frame surrounded by the railings has two layers. The layer with higher vertical height is flush with the top of the hoisting machine 10 or is higher than the top of the hoisting machine 10. The layers of railings are connected with each other by using vertical railings 12. One end of the vertical railing 12 is connected to the end part of the horizontally arranged railing on the higher layer, and the other end is fixedly connected to the load-bearing bottom frame 4.

As shown in FIG. 1, an inner ceiling plate 8 is arranged above the railings. An outer ceiling plate 9 is arranged above the inner ceiling plate 8. The inner ceiling plate 8 and the outer ceiling plate 9 are fixed and supported by using vertical section steel or rod pieces. In the present disclosure, the rod pieces used for supporting the inner ceiling plate 8 and the outer ceiling plate 9 include ceiling support pipes 16 and ceiling sleeves 17 coaxially arranged outside the ceiling support pipes 16 in a sleeving manner. The ceiling sleeves 17 are fixed to the skirting boards through the parts, such as cross pipe clamps 18 and inclined bracing pipes 19. The fixing structures are prior art, so they are not described in detail herein. Relative position between the ceiling support pipes 16 and the ceiling sleeves 17 is kept unchanged. All cross sections of the elevator platform are rectangles with the same size. The ceiling support pipes 16 and the ceiling sleeves 17 are also fastened through locking nuts 21 and locking taper sleeves 22. A plurality of notches are formed in the two sides of the inner ceiling plate 8 and the outer ceiling plate 9 in the horizontal direction of a guide rail surface. The size of the guide rail surface in the horizontal direction can be changed by adjusting the positions of the overlapped notches. When the positions of the overlapped notches are adjusted, all notches drawn in the accompanying drawings can be overlapped, and the notches can be overlapped from the elevator platform retracting to the smallest to stretching to the largest. Meanwhile, circular holes are formed in the vertical direction of the guide rail surface. The included angles between the two ceiling pairs can be changed by changing the installation positions of the ceiling support pipes 16 and circular holes of the ceiling plate and the spacing between the ceiling sleeves 17, so as to change the size of the ceiling in the vertical direction of the guide rail surface.

Figure 9:
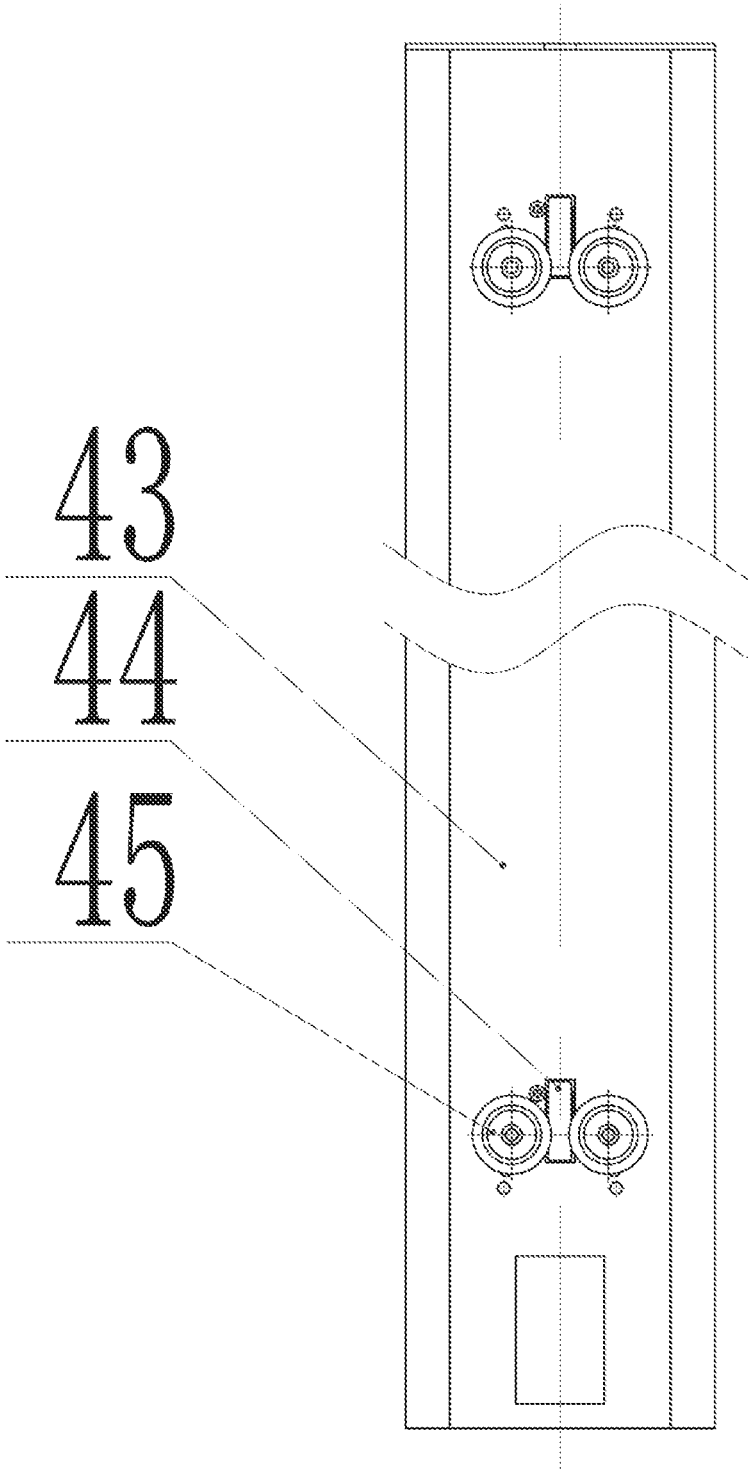
FIG. 9 is a schematic structural diagram of a vertical beam of the present disclosure.

As shown in FIG. 9, the assembly 20 of the vertical beam 43 includes a vertical beam 43, a rear roller 44, and side rollers 45. The two side rollers 45 and one rear roller 44 form a rolling guide shoe, wherein the two side rollers 45 are coplanar. The rear roller 44 is located between the two side rollers 45 and is arranged perpendicular to the side rollers 45. A rolling guide shoe is installed at each of the upper end and the lower end of the assembly 20 of the vertical beam 43. The rolling guide shoes are pressed against the elevator guide rails, so that the platform can run along the elevator guide rails.

The spacing between the two side rollers 45 can be determined through the hole positions on the vertical beam 43. The spacing between the rollers is changed by forming the hole positions with different spacing, so as to make the platform adapt to various different elevator guide rails. The spacing between the hole positions corresponds to the thickness of the guide rails. There are only a few common guide rail thicknesses, which are standardized. The guide rail is located between the rollers, so that the gap between the side rollers 45 only needs to be matched with several common guide rail thicknesses.

The platform lifting is powered by the hoisting machine 10. The hoisting machine 10 is installed at the middle position of the upper beam assembly 3, and can also be installed at the position of one side, close to the guide rail, of the elevator installation platform. Steel wire rope installation seats are provided on the opposite sides, which can realize a 2:1 transmission effect, so the load capacity can be greatly improved. The safety lock 11 is installed at the middle position of the upper beam assembly 3, and dual guarantee is performed through the safety clamps 1 and the safety lock 11. The two safety clamps 1 are connected through a telescopic rod consisting of the end screw 32, the middle screw 34, and the turnbuckle 33 in the lower beam assembly 2. The telescopic rod can transfer the displacement of the safety clamp 1 on one side to that on the other side, so as to trigger the safety clamps 1 synchronously. A specific process of synchronous triggering is: as shown in FIG. 5, one side of the telescopic rod on one side is tightened, and the other side of the telescopic rod is also tightened. The spring 31 provides elastic force to overcome the gravity of the safety clamps 1 to keep relative balance. During normal work, the spring 31 is kept in a stretched state, and the clamp bodies of the safety clamps 1 have weight, so the safety clamps 1 will be heavier on one side and lighter on the other side under the action of gravity if there is no spring 31, and the safety clamps 1 will be triggered easily. The function of the spring 31 is to overcome its own weight and keep it in balance.

Meanwhile, the telescopic rod of the lower beam assembly 2 is connected to the triggering plate 36 of the lower beam assembly 2. The triggering plate 36 and the rotating rod 35 are connected to a wedge-shaped pulling block of the safety clamp 1. The rotating rod 35 is also connected to a pulling plate 37 located on one side, deviating from the telescopic rod, of the wedge-shaped pulling block. The pulling plate 37 can trigger the action of the safety clamps 1 by connecting a speed limiter of the elevator. The speed limiters are safety parts of the elevator, and are connected to the safety clamps 1 through steel wire ropes. When the speed reaches a certain value, the locking of the steel wire ropes is triggered, and the safety clamps 1 are drive to move, so that the elevator brakes on the guide rails. In the present embodiment, the speed limiters are applied to the installation platform, to lock the platform on the elevator guide rails firmly. The safety lock 11 is a centrifugal triggering safety lock 11, which is triggered when the descending speed of the platform reaches a set value, so as to lock the platform on the safety steel wire ropes firmly.

Figure 7:
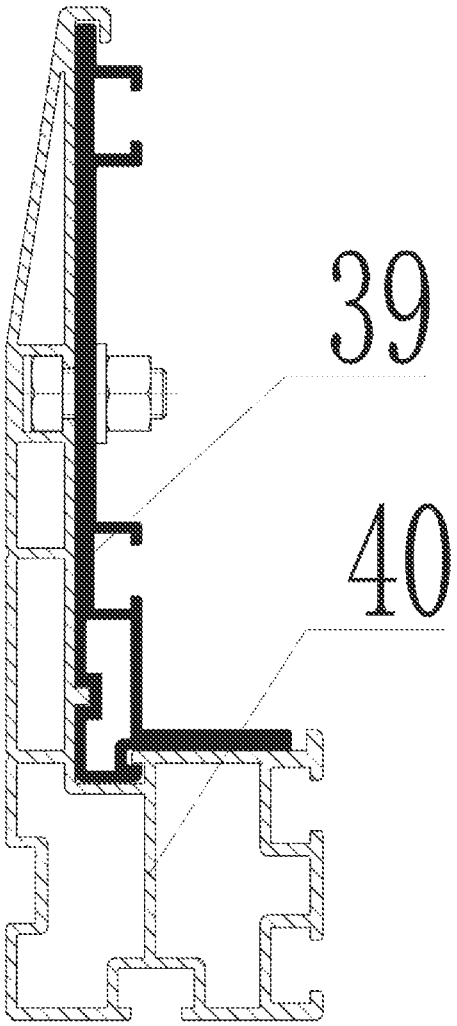
FIG. 7 is a connection schematic diagram of a skirting board of the present disclosure.
Figure 8:
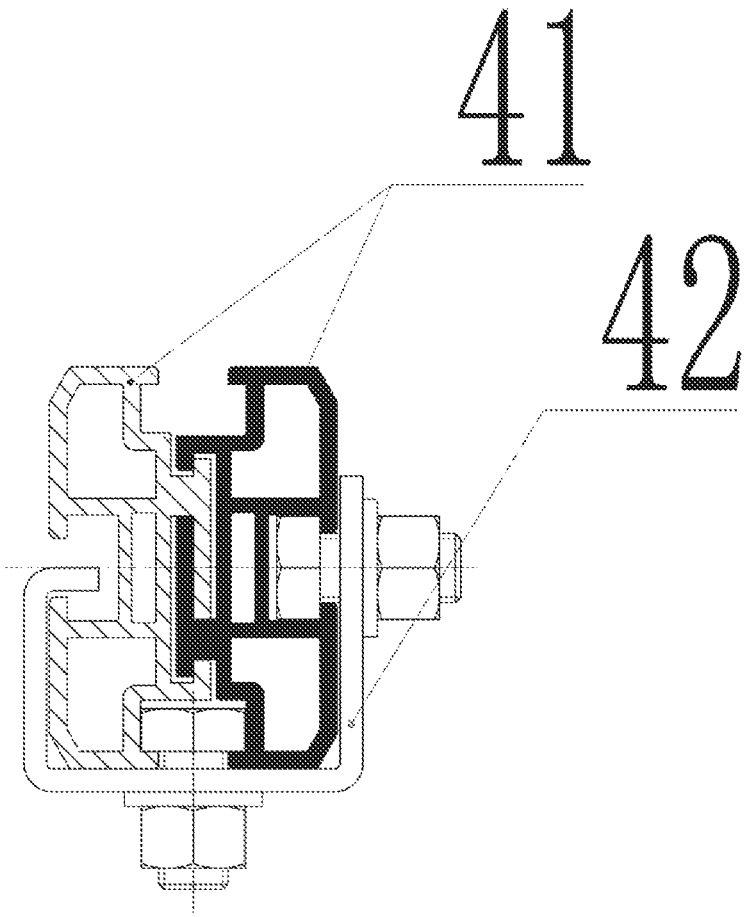
FIG. 8 is a connection schematic diagram of a transverse connecting rod of the present disclosure.

As shown in FIG. 7 and FIG. 8, the first skirting boards 39, the second skirting boards 40, and the transverse connecting rods 41 of the load-bearing bottom frame 4 are specially designed aluminum profiles, which are provided with T-shaped and I-shaped chutes, T-shaped, I-shaped, and L-shaped bosses. The chutes and the bosses can be embedded and engaged with each other. As shown in FIG. 7, the first skirting boards 39 and the second skirting boards 40 are embedded and engaged with each other, and can slide freely in the axial directions of the second skirting boards 40. As shown in FIG. 8, the two transverse connecting rods 41 are embedded and engaged to form a pair of telescopic cross beams with an upper surface and a lower surface overlapped with each other, which can slide freely along the axes of each other. In this way, the load-bearing bottom frame 4 can perform stepless stretching and retracting in four directions.

As shown in FIG. 4 and FIG. 5, two rows of a plurality of inclined long holes that are symmetrically distributed along the horizontal plane are respectively formed in the inner sides of the upper beam left C steel 23 and the upper beam right C steel 26, and the two sides of the upper beam middle C steel 24, and stepless stretching and retracting is realized by adjusting the overlapping positions of the long holes. A specific adjustment process is as follows: as shown in FIG. 4, when the upper beam left C steel 23 moves to the upper beam middle C steel 24. The hole positions of the upper beam left C steel 23 and the upper beam middle C steel 24 form a V shape first, at this time, the bottoms of the long holes are overlapped; then, the hole positions of the upper beam left C steel 23 and the upper beam middle C steel 24 form an X shape, at this time, the middle positions of the long holes are overlapped; finally, the hole positions of the upper beam left C steel 23 and the upper beam middle C steel 24 form a ^ shape, at this time, the tops of the long holes are overlapped. Finally, the two long holes are separated, other holes are overlapped, so that the stepless stretching and retracting of the upper beam assembly 33 in the horizontal direction of the guide rail surface can be realized. The interiors of the long holes are fixed by bolts. Long holes are also formed in the lower beam left C steel 27, the lower beam middle C steel 28, and the lower beam right C steel 29 of the lower beam assembly 2. The forms of the long holes are the same as those of the upper beam assembly 3, so as to realize stepless stretching and retracting of the lower beam assembly 22 in the horizontal direction of the guide rail surface.

External screw threads with opposite screw directions are formed in one side of the end screw 32 and one side of the middle screw 34 of the lower beam assembly 2. Internal screw threads with opposite screw directions are formed in the two sides of the turnbuckle 33. A screw part can be stretched (i.e. extended) or retracted steplessly by rotation. A circular pipe with a hole in the end part is arranged on the other side of the middle screw 34. A plurality of circular holes are formed in the end connecting rod 46, the connecting rod part can also be stretched or retracted by adjusting the overlapped circular holes of the middle screw 34 and the end connecting rod 46. That is, stepless stretching or retracting can be realized by transforming the positions of the overlapped holes and adjusting the screw threads. The transformation of the overlapped holes is adjusted quickly, but cannot realize stepless adjustment, which is used for rough adjustment, and the adjustment of the screw threads is used for fine adjustment.

A specific working process is as follows:

The two side rollers 45 and the rear roller 44 of the assembly 20 of the vertical beam 43 serve as guide shoes to limit the platform on the elevator guide rails. Two locking wedge-shaped blocks of the safety clamps 1 are respectively placed on the two sides of the guide rails and are kept in a relaxed state. One end of each working steel wire rope is fixed to the steel wire rope fixing seat 5, and the other end of each working steel wire rope penetrates into the hoisting machine 10 through a pulley at the top of a shaft, and the whole platform is driven to move up and down through the hoisting machine 10. A safety steel wire rope penetrates into the safety lock 11. When the platform descends quickly due to the breakage of the working steel wire ropes or other unexpected situations and if the rope locking speed of the safety lock 11 is reached, the safety lock 11 is triggered to lock the platform to the safety steel wire rope firmly. If the triggering speed of the speed limiters of the elevator is reached, the speed limiters make the safety clamps 1 work by tensioning speed limiting steel wire ropes. If the two safety clamps 1 are connected together through the end screw 32, the middle screw 34, and the like, the two safety clamps 1 act together to lock the platform on the elevator guide rails firmly. After the fault is eliminated, the safety lock 11 or the speed limiters are unlocked, the platform is driven to go upward by using the hoisting machine 10, the safety clamps 1 return to the relaxed state under the action of the spring 31, and the platform can return to normal use.

Although the present disclosure has been disclosed as above by preferred embodiments, they are not used to limit the present disclosure. Any person skilled in the art can make various changes and modifications without departing from the spirit and scope of the present disclosure. Therefore, the scope of protection of the present disclosure should be as defined in the claims.

What is claimed is:

1. A heavy load elevator installation platform capable of stretching and retracting steplessly, comprising an upper beam assembly and a lower beam assembly that can realize stepless stretching and retracting, wherein the upper beam assembly comprises:

upper beam left C steel, located at the bottom of an elevator platform to achieve a supporting effect, and a plurality of long holes formed at an inclined included angle with the horizontal being formed in the inner side wall of the upper beam left C steel;

upper beam middle C steel, connected to one end of the upper beam left C steel;

upper beam right C steel, connected to one end, deviating from the upper beam left C steel, of the upper beam middle C steel, and a plurality of long holes formed at an inclined included angle with the horizontal being formed in the inner side wall of the upper beam right C steel, wherein a plurality of long holes are respectively formed in the two side surfaces, facing the upper beam left C steel and the upper beam right C steel, of the upper beam middle C steel; the long holes are formed at an inclined included angle with the horizontal; the inclination directions of the long holes of the upper beam middle C steel are opposite to the inclination directions of the long holes in the upper beam left C steel and the upper beam right C steel;

the lower beam assembly comprises:

lower beam left C steel, located at the bottom of an elevator platform to achieve a supporting effect, and a plurality of long holes formed at an inclined included angle with the horizontal being formed in the inner side wall of the lower beam left C steel;

lower beam middle C steel, connected to one end of the lower beam left C steel;

lower beam right C steel, connected to one end, deviating from the lower beam left C steel, of the lower beam middle C steel, and a plurality of long holes formed at an inclined included angle with the horizontal being formed in the inner side wall of the lower beam right C steel, wherein a plurality of long holes are respectively formed in the two side surfaces, facing the lower beam left C steel and the lower beam right C steel, of the lower beam middle C steel; the long holes are formed at an inclined included angle with the horizontal; the inclination directions of the long holes of the lower beam middle C steel are opposite to the inclination directions of the long holes in the lower beam left C steel and the lower beam right C steel.

2. The heavy load elevator installation platform capable of stretching and retracting steplessly according to claim 1, wherein the inclined long holes in the upper beam middle C steel and the lower beam middle C steel are set as even rows, and are symmetrically formed by taking a central point of the upper beam middle C steel or the lower beam middle C steel as a center of symmetry.

3. The heavy load elevator installation platform capable of stretching and retracting steplessly according to claim 1, wherein a telescopic rod is further arranged at the lower beam assembly; lower beam support seats are arranged at two ends of the lower beam assembly; the telescopic rod comprises:

an end screw, one end being connected to a lower beam support seat at the lower beam right C steel, and the other end pointing to the lower beam middle C steel;

a middle screw, connected to one end, deviating from the lower beam right C steel, of the end screw, and a turnbuckle being connected between the middle screw and the end screw;

an end connecting rod, connected to one end, deviating from the end screw, of the middle screw, and being in threaded connection with the middle screw.

4. The heavy load elevator installation platform capable of stretching and retracting steplessly according to claim 3, wherein external screw threads with opposite screw directions are formed in the outer circular surfaces of the ends, that are close to each other, of the end screw and the middle screw; internal screw threads with opposite screw directions are formed in the inner walls of two ends of the turnbuckle.

5. The heavy load elevator installation platform capable of stretching and retracting steplessly according to claim 3, wherein one end, deviating from the end screw, of the middle screw is set as a circular tubular shape; a plurality of holes are formed in the outer circular surface of the circular tubular section; a plurality of holes that can be overlapped with the holes in the middle screw are formed in the outer circular surface of one end, close to the middle screw, of the end connecting rod.

6. The heavy load elevator installation platform capable of stretching and retracting steplessly according to claim 1, wherein a triggering plate is arranged on the lower beam left C steel; a pin hole is formed in the triggering plate; a rotating rod used for fixing the triggering plate is penetrated in the pin hole; the rotating rod rotates around the pin hole at the lower beam left C steel.

7. The heavy load elevator installation platform capable of stretching and retracting steplessly according to claim 6, wherein a load-bearing bottom frame consists of a plurality of profiles with grooves and bumps that are engaged with each other, and comprises skirting boards and transverse connecting rods that are arranged perpendicular to each other; the transverse connecting rods are located at the bottom surface of the load-bearing bottom frame; the skirting boards surround the periphery of the load-bearing bottom frame.

8. The heavy load elevator installation platform capable of stretching and retracting steplessly according to claim 7, wherein the skirting boards comprise first skirting boards and second skirting boards that are engaged with each other; the first skirting boards are located on the periphery of the load-bearing bottom frame; the first skirting boards and the second skirting boards are connected end to end in pairs; each second skirting board is located at the middle section position of the corresponding first skirting board; the first skirting boards perform sliding movement along the axial direction of the second skirting boards.

9. The heavy load elevator installation platform capable of stretching and retracting steplessly according to claim 7, wherein the two transverse connecting rods are embedded and engaged with each other to form a pair of telescopic cross beams with an upper surface and a lower surface overlapped with each other; the two transverse connecting rods perform relative sliding movement along the axes of each other.

10. The elevator installation platform according to claim 1, further comprising a vertical beam located at the outer side wall of the elevator platform, wherein a plurality of circular holes that are symmetrically distributed along the middle surface of the vertical beam and are used for installing side rollers are formed in the vertical beam; the difference between the spacing of the circular holes and the diameter of the side rollers is wider than the width of an elevator guide rail outside.

* * * * *